United States Patent [19]

Goglio

[11] 3,949,934

[45] Apr. 13, 1976

[54] CONTAINER HAVING A VALVE MOVABLE BETWEEN ONE-WAY FLOW AND CLOSED POSITIONS

[76] Inventor: Luigi Goglio, Via Solari 10, Milan, Italy

[22] Filed: May 24, 1974

[21] Appl. No.: 473,311

[30] Foreign Application Priority Data

June 14, 1973 Italy ..... 25370/73

[52] U.S. Cl. ..... 229/62.5; 137/525; 150/9; 220/208; 220/209; 222/396; 222/494

[51] Int. Cl.[2] ..... B65D 31/14

[58] Field of Search ..... 137/525, 525.3; 229/62.5; 150/9; 220/208, 209, 374, 206, 266; 222/396, 494

[56] References Cited

UNITED STATES PATENTS

| | | | |
|---|---|---|---|
| 3,527,376 | 9/1970 | Young, Jr. | 220/209 |
| 3,595,467 | 7/1971 | Goglio | 229/62.5 |
| 3,618,825 | 11/1971 | Clarke | 222/494 |
| 3,633,605 | 1/1972 | Smith | 137/525 |
| 3,799,427 | 3/1974 | Goglio | 229/62.5 |
| 3,807,445 | 4/1974 | McPhee | 137/525 |

*Primary Examiner*—William Price
*Assistant Examiner*—Stephen P. Garbe
*Attorney, Agent, or Firm*—Steinberg & Blake

[57] ABSTRACT

A container for packing up products characterized by at least a one-way passage from inside to outside the container, and after sterilizing the filled up container, structure for closing said one-way passage to separate the inside from the outside of the container.

3 Claims, 7 Drawing Figures

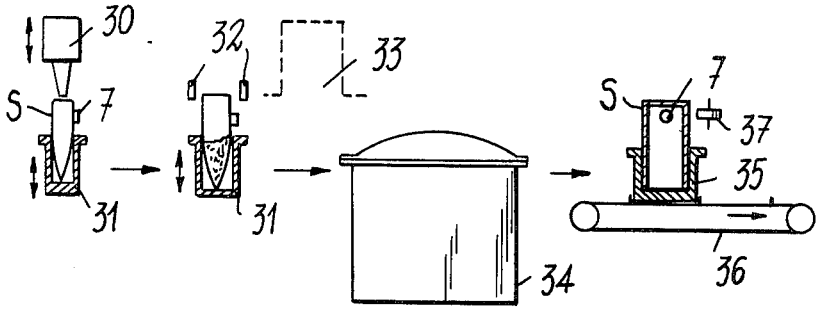
Fig. 4
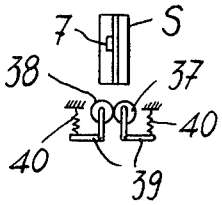
Fig. 5
Fig. 6
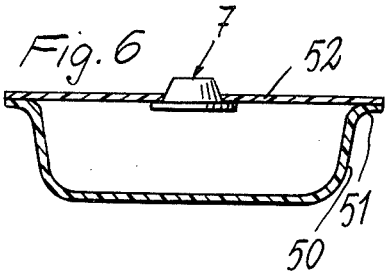
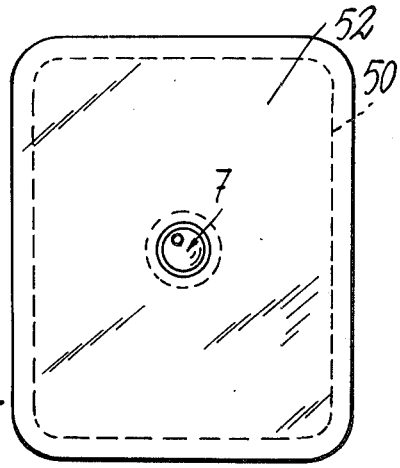
Fig. 7

CONTAINER HAVING A VALVE MOVABLE BETWEEN ONE-WAY FLOW AND CLOSED POSITIONS

This invention relates to a container for packing up products with the container being made of material of any kind (flexible, semirigid and rigid). More particularly, the invention relates to a container for packing such products as foodstuffs to be sterilized or pasteurized.

A method is known, consisting of introducing a precooked food into containers having a plurality of heat sealable layers, vacuum closing the filled up container and then sterilizing it in autoclave.

This known method suffers from some disadvantages, the most significant of which are the following:

a. Vacuum sealing must be effected prior to sterilization, since in presence of vacuum the contained product would otherwise enter in ebullition jeopardizing the provision of a perfect tight sealing. For the same reason, the product should be introduced at cold condition, but this is opposed by the high cost of cooling. Should the product be introduced at hot condition to avoid the cost of cooling, considerable discards would be encountered, as well as difficulties due to sealing defects at the closure welding since the product enters in ebullition, as above mentioned.

b. Even in case of cold products, it was found that the closure welding is often faulty in that under vacuum some liquid is drawn to the container mouth, thereby wetting the edges to be welded.

c. During the vacuum phase, the container is readily deformed, when flexible or semirigid, so that wrinkles or folds are built up and compromise the tight sealing of the weld.

d. When sterilizing in autoclave, the pressure should be carefully controlled to prevent the containers from bursting.

The container of the invention permits to overcome all of such disadvantages.

According to the invention, a container is essentially characterized by providing a fully interceptable one-way valve, comprising a base body attached to the container and fitted with at least one passage, a cover or lid provided with at least one passage and connectable at at least two distinct positions with said base body, and a resilient body interposed between the lid and the base body and intercepting or cutting off the passage in the base body.

At one of said connecting positions for the lid, the valve operates as one-way valve, thus allowing the passage of fluids from inside to outside of the container, while at the second connecting position the valve is closed in both directions, without any possibility of exchanges between inside and outside of the container.

The invention will be better understood from the following detailed description, given by mere way of not limiting example, for an embodiment thereof shown in the appended drawings, in which.

FIG. 4 schematically shows the several operation of the method where envelopes are concerned;

FIG. 5 is a top view showing the means for completely closing the valve where envelopes are concerned; and FIGS. 6 and 7 are sectional and plan views, respectively, showing a trough type of rigid container provided with a valve.

Figure 1:
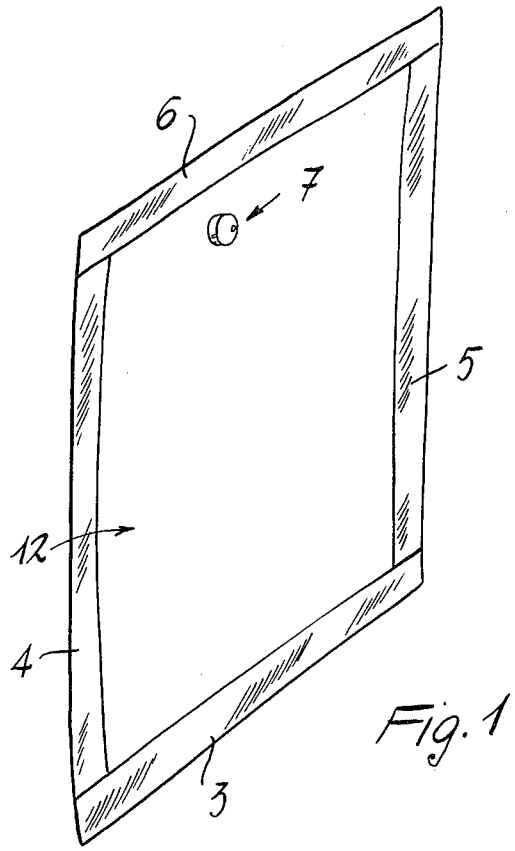
FIG. 1 is a perspective view showing an envelope fitted with a valve.
Figure 2:
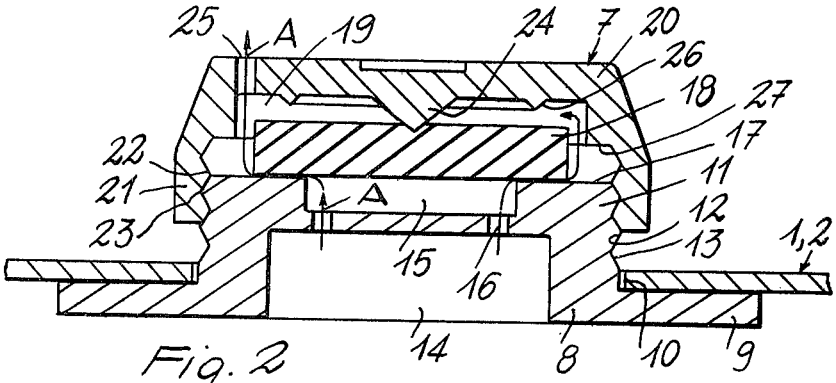
FIG. 2 is an axial section showing the valve at one of its positions.
Figure 3:
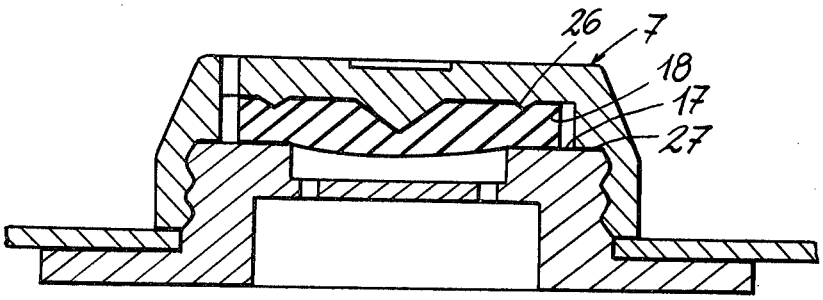
FIG. 3 is a sectional view showing the valve at its other position of complete interception or cut off.

Referring to FIGS. 1–3, the flexible container therein shown comprises an envelope formed of two sheets 1, 2 of heat sealable material, such as a laminate including a plurality of layers, the intermediate of which may be of aluminum. The other layers may be of plastics, such as polyethylene, polypropylene, polyesther, etc. Preferably, the inner layer is of polypropylene.

In the example shown, the two sheets 1, 2 are sealed or welded along three sides 3, 4, 5, as shown in the hatched zones and following product introduction also on the fourth side 6. In one of the sheets, an aperture 10 is formed and along its contour has a valve 7 heat welded thereto.

The valve includes a base body 8 of thermoplastic material, such as polypropylene, provided with a contour flange 9 by means of which the base body 8 and hence the valve is heat welded to the container.

The base body 8 has a central lug 11 having on its outer face a series of annular ridges 12 alternating with depressions 13. Ridges and depressions are complementary and substantially of triangular shape in cross-section. The base body 8 has also two recesses 14, 15 intercommunicating through a series of passageways 16.

A disc 18 of easily deformable soft rubber adhers against the planar top face 17 of said lug 11. This disc 18 is located within a chamber 19 defined by lug 11 and a lid 20 also made of thermoplastic material, such as polypropylene. The lid 20 has a side 21, the inner face of which is provided with a series of alternating annular ridges and depressions 22 and 23, respectively. These ridges 22 and depressions 23 correspond to those 12, 13 of the central lug 11.

At the position shown in FIG. 2, the lid 20 engages the central lug 11 so that one ridge and one depression of the lid will respectively mesh one depressione and one ridge of the lug 11. The engagement is effected by a snap action on exerting some pressure on the lid 20, taking advantage of the elastic deformability of the parts. At this position, a central conical projection 24 of the lid 20 acts upon the disc 18, whereby the latter adheres with some pressure on said surface 17.

The lid 20 has also a passageway 25 communicating the chamber 19 with the external environment. About the conical projection 24 there is provided a continuous rib 26 of triangular cross-section and less height than the conical projection and larger diameter than the recess 15. When the lid 20 is fully coupled with the central lug 11 (FIG. 3), which is effected by forcing said lid to provide the interengagement of all the ridges and depressions and contact of the inner step 27 with the face 17, the annular rib 26 penetrates into the disc 18 causing it to forcibly adhere to the surface 17.

While at the position shown in FIG. 2, the valve 7 operates as a one-way valve allowing a passage of fluids from inside to outside of the container, at the position shown at FIG. 2 the valve is completely closed, inhibiting any communication in both directions.

Thus in FIG. 2 and in case of inner overpressures, the disc 18 would raise along the contour of said surface or wall 17, and therefore the fluids can outwardly discharge by following the paths shown by the arrows A. In case of outer overpressures, the disc 18 would be pressed against the wall 17, so that fluids are prevented from entering.

FIGS. 4 and 5 show a possible packing up method.

In a bag S (such as that shown in FIG. 1) provided with a valve 7 and at the position shown in FIG. 2, a metered amount of either hot or cold alimentary product is introduced, such as by a metering apparatus 30. The bag S is contained in a form 31 capable of raising and lowering and being placed on a conveyor. After loading the product, the form 21 arrives at a pair of welding bars 32, which can be moved to and away from each other and close the bag mouth or inlet, providing the transverse weld 6 of FIG. 1.

Then, but not necessarily, the form 31 may reach below a cone or bell 33 connected to a vacuum source when the form 31 is applied against the bottom countour of said bell, and this to cause air exit through the one-way operating valve. The envelope or bag is then charged into an autoclave 34 for sterilization and then into a form 35 placed on a conveyor 36. During all of these steps, the valve 7 is always at the position shown in FIG. 2. As the conveyor 36 moves, the bag is driven between rollers 37, 38 resiliently pressed against each other at the level of the valve 7, and forcing the valve lid 20, causing the valve to take the full cutoff attitude of FIG. 3.

As shown in FIG. 5, the two rollers 37, 38 are carried at the ends of two crank levers 39, hinged to fixed locations at the crank thereof, at the free ends being connected to traction springs 40.

The container evacuation prior to sterilization is optional as well as the autoclave process. Thus, when heating a container and associated valve, such as that herein described, and containing a food product having a certain degree of moisture, the food temperature will gradually reach the predetermined value. Should this value exceed the boiling temperature for the liquids (water), within the container, an overpressure would automatically occur, whereby the steam generated would be caused to exit through the valve along with the air in the container.

That is, in this flushing step the steam outwardly forces the lighter air, so that an environment comprising steam with minimal traces of air is built up within the envelope or container.

At the next cooling step, the steam condenses in the container, so that the latter is ecavuated as the one-way valve prevents the outside air from entering the container. Now, a room temperature airless container is provided, in which the steam is completely condensed.

The complete cutoff of the valve (position shown in FIG. 3) is required to avoid that, when normally handling the container (such as an envelope), an overpressure with resulting outflow of liquid might be built up within it.

From the foregoing, it should be appreciated that continuous sterilizing processes can be carried out, not being essentially necessary to exert a pressure on the containers to equalize the pressure building up within the container. This equalization was required to prevent the container from bursting.

The term "sterilization", as herein used, is intended to include such processes for increasing the preservability of foodstuffs, reducing the starting level of the bacterial charge. For instance, the term "sterilization" not only includes pastuerizing and tendering processes, but also I.R. or microwave heating processes bringing the products to temperatures exceeding 100°C, as well as those using ultraviolet radiations and the like, as ordinarily used in the alimentary field.

Although the invention has been described in connection with flexible containers, it is apparent that it could be applied to rigid containers, such as those of drawn aluminum, provided with a cover, having therein a layer of heat sealable plastics. Such a container is shown in FIGS. 6 and 7 and comprises a trough or basin 50 having a peripheral flange 51, to which the cover 52 is heat welded following contents introduction. The cover is fitted with the same valve 7 as in the preceding figures.

The connection between the valve lid 21 and base body 8 could be also of the screw and bayonet type, instead of the snap type by the complementary annular ridges and depressions, such as 12, 13, 22 and 23 of FIGS. 2 and 3.

What I claim is:

1. In a container, a wall defining at least part of the interior of the container and a valve having a base body fixed to said wall and formed with at least one passageway through which fluid can flow from the interior to the exterior of the container, a lid also formed with at least one passageway, and connecting means connecting said lid to said base body for movement between at least two different positions with respect to said base body, a resilient body being interposed between said lid and base body and normally occupying a position closing off communication between the interior of the container and the outer atmosphere through said passageway of said base body, said lid having a central projection pressing on said resilient body, and said lid also having a rib concentric with said central projection and of a lesser depth than the latter for engaging the resilient body in one position of said lid to hold said resilient body in a closed position and to be spaced from said resilient body in another position while said central projection still presses on said resilient body, to release said resilient body to permit one-way flow out of the interior of the container.

2. In a container, a wall defining at least part of the interior of the container and a valve having a base body fixed to said wall and formed with at least one passageway through which the interior of the container can communicate with the outer atmosphere, a lid also formed with at least one passageway, means connecting said lid to said base body for movement between at least two different positions with respect thereto, and a resilient body interposed between the lid and base body for permitting one-way flow out of the interior of the container to the outer atmosphere through said passageway of said base body in one position of said lid and for maintaining the latter passageway closed in another position of said lid, said connecting means including at said lid a peripheral wall provided with alternating ridges and depressions, and said base body having a projection formed at a location cooperating with said ridges and depressions of said peripheral lid wall to allow a snap interconnection at preselected positions corresponding to said two different positions of said lid.

3. The combination of claim 2 and wherein said lid has a central projection pressing on said resilient body in a position of said lid where fluid under sufficient pressure can escape through said passageway of said base body while deflecting said resilient body to travel through said passageway of said lid to the outer atmosphere, and said lid also having concentrically surrounding said central projection a rib which engages and presses against said resilient body in a second position of said lid with respect to said base body for holding said resilient body in a permanently closed position, whereby the valve constitutes a one-way valve which is capable of being closed according to the position selected for said lid.

* * * * *